United States Patent [19]

Melton et al.

[11] Patent Number: 4,496,126

[45] Date of Patent: Jan. 29, 1985

[54] TABLE MOUNTED UNIVERSALLY POSITIONABLE BOOK HOLDER ENABLING READERS TO TURN PAGES EASILY WITHOUT HANDS

[76] Inventors: R. Stanley Melton, Rte. 2, Box 199A; James R. Davis, Rte. 2, Box 234, both of Ellenboro, N.C. 28040

[21] Appl. No.: 397,917

[22] Filed: Jul. 13, 1982

[51] Int. Cl.[3] ..... A47B 23/04

[52] U.S. Cl. ..... 248/447.2; 248/445; 248/451; 248/454; 248/465.1

[58] Field of Search ..... 248/441 A, 441 B, 441 C, 248/441 D, 445, 452, 451, 454, 441 R, 453, 443, 457, 442.2; 108/3

[56] References Cited

U.S. PATENT DOCUMENTS

| | | | |
|---|---|---|---|
| 311,514 | 2/1885 | Noyes | 248/453 |
| 883,433 | 3/1908 | Utz | 248/441 D |
| 1,035,290 | 8/1912 | Wood . | |
| 1,130,559 | 3/1915 | Allen | 248/442.2 |
| 1,239,655 | 9/1917 | Wood | 248/451 |
| 2,448,734 | 9/1948 | Phillips | 248/445 |
| 2,780,027 | 2/1957 | Laing . | |
| 2,810,231 | 10/1957 | Lykes | 248/451 |
| 3,007,278 | 11/1961 | Million . | |
| 3,106,376 | 10/1963 | Scott | 248/441 C |
| 3,128,573 | 4/1964 | Johnson et al. . | |
| 3,338,629 | 8/1967 | Drees | 248/451 X |
| 3,514,066 | 5/1970 | Singleton et al. . | |
| 3,813,075 | 5/1974 | Capper | 248/451 X |
| 3,889,914 | 6/1975 | Torme . | |
| 3,894,709 | 7/1975 | Weir . | |
| 4,015,813 | 4/1977 | Graham . | |
| 4,294,425 | 10/1981 | Weber . | |

FOREIGN PATENT DOCUMENTS

| | | | |
|---|---|---|---|
| 2312213 | 10/1976 | France | 248/451 |

*Primary Examiner*—Peter M. Caun
*Assistant Examiner*—David L. Talbott
*Attorney, Agent, or Firm*—Laurence R. Brown

[57] ABSTRACT

A simplified and inexpensive book holder for use by readers without arm mobility is operable for both reclining and sitting readers. Reading visibility is not obscured by page holding clamps. Thus, a set of monofilament lines is horizontally disposed across the open pages of a book to hold them in reading posture. These lines also provide simple page turnability by means of a stick held in the mouth. The construction thus is basically a four walled framework with two or three monofilament lines across one open end. A set of clamps extending inwardly from the walls holds a book cover in place with the pages open. A pivoted set of clamps attached to the walls will mount the book holder on the edge of a table for reading in vertically oriented sitting position or horizontally oriented reclining position.

1 Claim, 6 Drawing Figures

FIG. 1
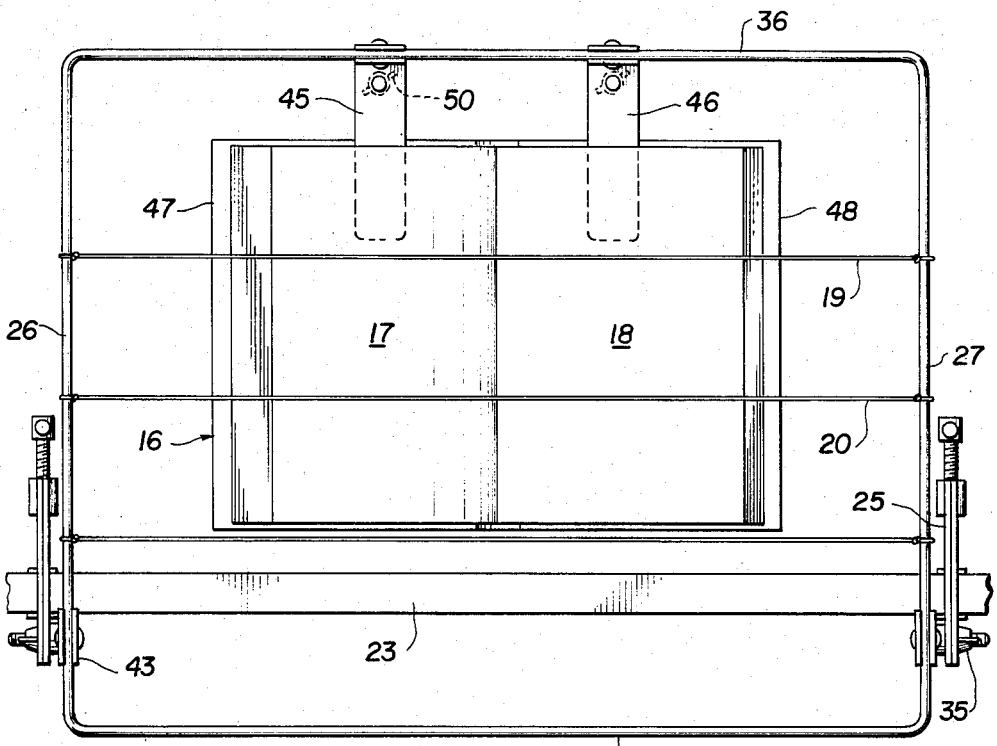
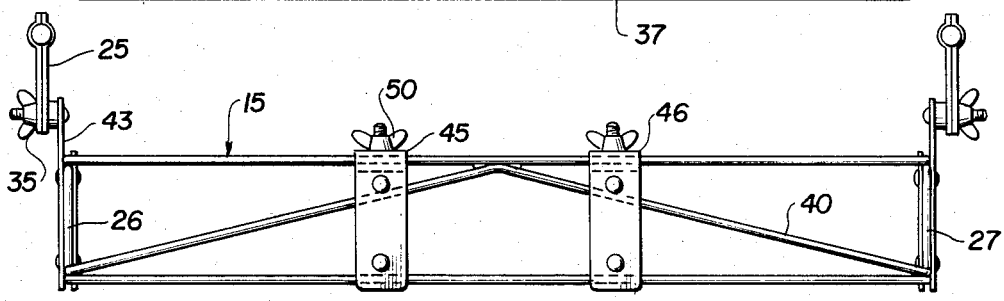
FIG. 2
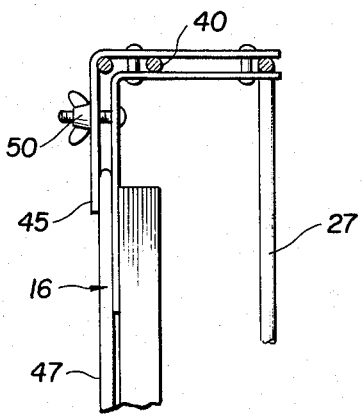
FIG. 3

TABLE MOUNTED UNIVERSALLY POSITIONABLE BOOK HOLDER ENABLING READERS TO TURN PAGES EASILY WITHOUT HANDS

TECHNICAL FIELD

This invention relates to book holders for persons without arm mobility and more particularly it relates to improvements in such book holders for facilitating the turning of pages, increasing visibility, reducing cost and permitting use in both reclined and sitting positions.

BACKGROUND ART

Various types of book holders for persons without arm mobility have been proposed, as represented by the following U.S. patents briefly discussed.

A. E. Wood—U.S. Pat. No. 1,035,290—Aug. 13, 1912 provides a framework for holding a book in front of a sitting person where the book is held in place by vertically disposed elastic bands about the book covers and the book is held open by a horizontally disposed elastic band stretched across the opened pages. This holder cannot be used by bedridden readers and the pages cannot be easily turned without the use of arms. Also, the horizontal elastic band across the opened pages interferes with visibility and need be changed in position as the pages are read.

The pages are generally held open in other book holders by differently shaped and positioned clamps for engaging separately the two opposed pages and holding them in reading position. The clamps are in most cases elastically biased for permitting use with uneven stacks of pages on opposite sides of the book. This type clamp is common to all of the patents discussed hereinafter. One problem with elastically biased clamps is the difficulty for a person without arm mobility to turn pages by fitting a page under the biased clamp. If the bias is missing, it is difficult to hold the pages open for both sitting and bedridden readers.

Some holders such as those in T. L. Million—U.S. Pat. No. 3,007,278—Nov. 7, 1961 and T. A. Graham—U.S. Pat. No. 4,015,813—Apr. 15, 1977 are portable and usable only in a table mount position. Others such as S. M. Weir—U.S. Pat. No. 3,894,709—July 15, 1975; E. G. Singleton et al.—U.S. Pat. No. 3,514,066—May 26, 1970; M. H. Torme—U.S. Pat. No. 3,889,914—June 17, 1975; P. J. Weber—U.S. Pat. No. 4,294,425—Oct. 13, 1981; B. V. Laing—U.S. Pat. No. 2,780,027—Feb. 5, 1957; and L. C. Johnson et al.—U.S. Pat. No. 3,128,573—Apr. 14, 1964 have complex mounts for attachment to beds and are generally adaptable only for use by bedridden users. The mounts make these book holders expensive and special purpose, and in most cases must be custom tailored for each bed size or style. Also they take up considerable room and are not easily stored.

It is an objective of this invention to improve the state of this art by resolving the aforesaid deficiencies and to provide an inexpensive, versatile, universally positionable book holder, which permits readers without arm mobility to simply and easily turn pages without inconvenience or outside assistance. Other objects, features and advantages of the invention will be found throughout the following description and in the accompanying drawings and claims.

DISCLOSURE OF THE INVENTION

This invention provides a universally usable book holder for persons without arm mobility. Thus, it can be used in either reclining or sitting position, is inexpensive, compact and readily storable. Essentially, it consists of four parts, namely: (1) a set of clamps for mounting on a table (over a bed or alongside a chair) for positioning (2) an open rectangular framework for displaying an open book with (3) cover clamps to hold the book covers and having (4) a set of monofilament plastic lines for keeping the book open to display a pair of opposed pages and to facilitate the turning of the pages by the reader with a mouth manipulated rubber tipped stick for example.

The inexpensive monofilament line mount, typically using lengths of "nylon" fishing line, do not disturb reading by visibly blocking out a portion of the open page and do not establish a strong bias which makes it difficult to turn pages while reading.

The clamp mount clamps on an edge of a table to hold the framework substantially vertically for reading in sitting position with two or three lines disposed horizontally across the open pages to hold them open and partially flattened for reading. When a conventional table moves over a hospital type bed, for example, and the framework is clamped to the edge of the table, it holds the book horizontally with the opened pages resting on the monofilament lines.

BRIEF DESCRIPTION OF THE DRAWINGS

In the drawings:

FIG. 1 is a front view of a book holder array afforded by this invention;

FIG. 2 is a bottom view of the book holder array;

FIG. 3 is a fragmental side view of the book holding clamp structure incorporated in the book holder array;

THE PREFERRED EMBODIMENT

Figure 5:
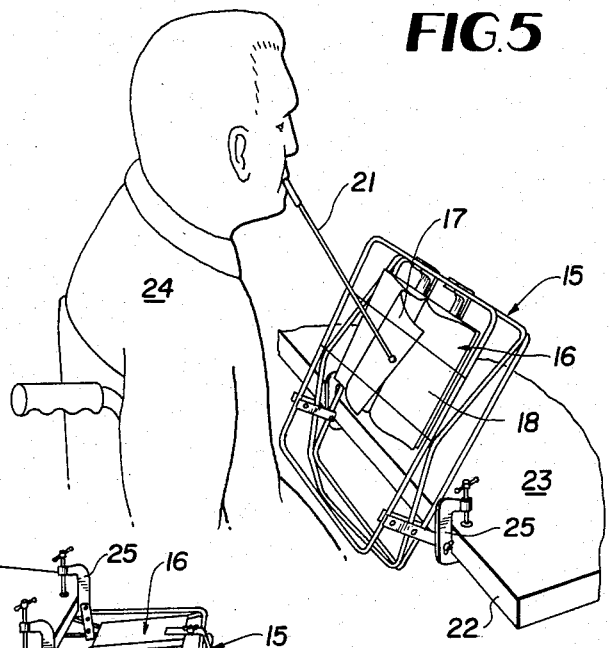
FIG. 5 is a perspective sketch showing a sitting reader using the book holder.

As may be seen from the various views, a four walled open ended book holder array 15 is adapted to hold a book 16 in place with pages 17, 18 opened in a substantially unobstructed sighting position visible in reading posture for reading by a reader in either sitting or reclining position. A set of monofilament lines 19, 20 of "nylon" fishing line, or the like, horizontally disposed across and in contact with the opened pages 17, 18 holds the pages in place without significant obstruction to reading. Also these lines facilitate turning pages while reading with a stick 21 held in the mouth of a reader 24 without arm mobility for example from either sitting position, FIG. 5 or reclined position, FIG. 6.

Figure 4:
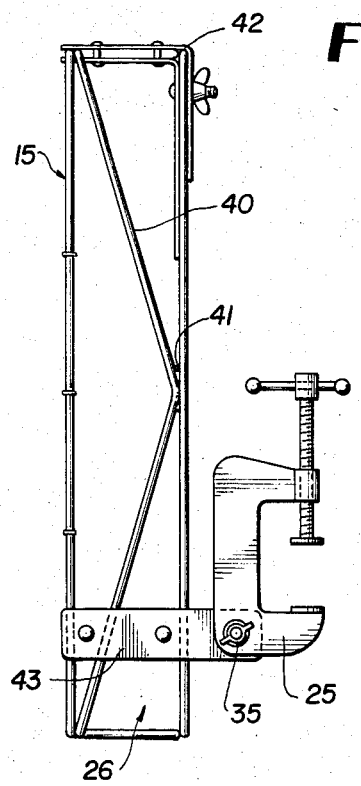
FIG. 4 is an end view of the book holder array showing the clamp structure for mounting the book holder on the edge of a table.
Figure 6:
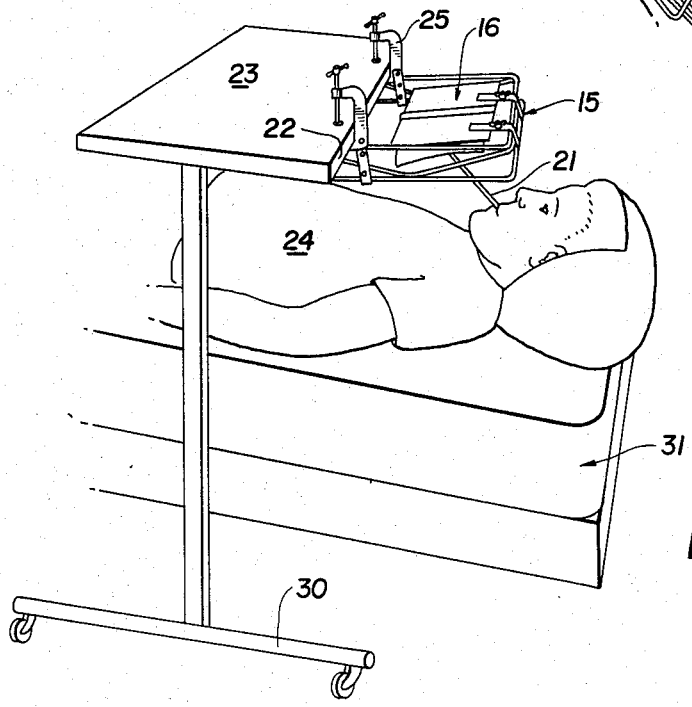
FIG. 6 is a perspective sketch showing a reclining reader using the book holder.

The book holder 15 is mounted on an edge 22 of a table 23 by means of clamps 25 mounted on opposite walls 26, 27 of the book holder 15 as shown in FIG. 4, for example. This table 23 can stand on the floor as in FIG. 5 and thus hold the book holder 15 more or less vertically, or alternatively may be on a mobile stand 30 to move over a bed 31 as shown in FIG. 6 to hold the book holder substantially horizontally.

To accomodate this universal mounting feature, the clamps 25 are pivoted about the book holder walls 26, 27 by means of a pivot bolt with a wing lock nut 35 for securing the pivot angle and thus holding the book 16 in the reading posture desired.

As seen from the front view of FIG. 1 and the end views of FIGS. 2 and 4, the book holder walls 26, 27, 36, 37 may be a framework of metal rods 40 secured together such as by welding at points 41, 42, etc. To this framework a first set of flanges 43 extend from walls 26, 27 for holding clamps 25, and a second set of flanges 45, 46 extend inwardly from the walls to mount means for retaining a book in place on the book holder 15.

The mounting means can simply comprise a spaced set of resilient metal sheet fingers and a bolt-wing nut clamping assembly 50 which tightens the fingers on the cover 47 of the book 16 to retain it in place. Thus, two covers 47, 48 are held and corresponding pages 17 and 18 being read are spread open for reading to contact the monofilament lines 19, 20.

It is therefore seen that a simple and effective improved book holder is provided that can be used easily by persons without arm mobility.

Having therefore set forth the invention, those features of novelty believed descriptive of the spirit and nature of the invention are defined with particularity in the claims.

We claim:

1. A book holder for use by readers without arm mobility adapted to hold a book in position for reading with pages displayed to enable turning by means of a rubber tipped stick held in the mouth, comprising in combination:

a pair of spaced front and rear juxtaposed rectangular frames of open framework metal rod construction for holding and positioning a book opened in reading posture with the book pages displayed at a substantially unobstructed sighting position for reading, book cover holder means carried by the rear rectangular frame for engaging and holding in place in opened posture for reading the two covers of a book, a pair of monofilament lines connected on opposite ends of said front rectangular frame facing the reader and disposed across the sighting position to contact open pages of the book and hold them open for reading without substantial visual interference of book pages said monofliament lines permitting manipulation of the pages by the stick employed by a reader, mounting means carried by said frames for attaching the framework to the edge of a table to hold the book in said reading posture comprising a pair of clamps extending from said framework for clamping to a table edge, a pivotable mount for said clamps on said framework to permit varying of the angular relationship of the framework with the clamp, and locking means to hold the pivotable mount secure in a selected mount position.

* * * * *